US005664724A

United States Patent [19]

Ho

[11] Patent Number: 5,664,724

[45] Date of Patent: Sep. 9, 1997

[54] COMPARTMENTIZED FILE FOLDER APPARATUS

[75] Inventor: I-Jong Ho, Taichung, Taiwan

[73] Assignee: Honn Hsin Enterprise Co., Ltd. (Taiwan corporation), Taichung, Taiwan

[21] Appl. No.: 597,410

[22] Filed: Feb. 8, 1996

[51] Int. Cl.[6] ..... B65D 30/20

[52] U.S. Cl. ..... 229/67.4; 206/425

[58] Field of Search ..... 229/67.1, 67.2, 229/67.3, 67.4; 206/425

[56] References Cited

U.S. PATENT DOCUMENTS

| | | | |
|---|---|---|---|
| 325,676 | 9/1885 | Jenkins | 206/425 |
| 975,792 | 11/1910 | Pittman | 229/67.4 |
| 1,455,419 | 5/1923 | Ahlquist | 229/67.1 |
| 1,722,911 | 7/1929 | Greenhaus | 229/67.4 |
| 2,333,798 | 11/1943 | Kner | 229/67.4 |
| 4,262,838 | 4/1981 | Mackenzie | 229/67.4 |
| 4,274,577 | 6/1981 | Walsh, Jr. | 229/67.3 |
| 5,271,502 | 12/1993 | Chang | 206/425 |

*Primary Examiner*—Stephen P. Garbe

*Attorney, Agent, or Firm*—Charles E. Baxley, Esq.

[57] ABSTRACT

A file folder includes a plate having a front panel, two side panels, a bottom panel, a rear panel, a top panel and a cover coupled together and folded relative to each other. A board has two side strips secured to the side panels so as to separate the file folder into a chamber and a room. Two expandable members are secured between the board and the rear panel such that the upper portion of the room can be opened. A number of partitions are secured to the expandable members so as to separate the room into a number of spaces for receiving various kinds of documents.

2 Claims, 3 Drawing Sheets

COMPARTMENTIZED FILE FOLDER APPARATUS

BACKGROUND OF THE INVENTION

1. Field of the Invention

The present invention relates to a file folder, and more particularly to a compartmentized file folder apparatus.

2. Description of the Prior Art

Typical file folders comprise an envelope type file folder including two panels having marginal portions secured together for protecting documents therein; and comprise an accordion like file folder including two side portions secured together by expandable members so as to allow the upper portion of the file folder to be opened. However, the file folders have no two or more compartments provided therein for receiving various kinds of documents.

The present invention has arisen to mitigate and/or obviate the afore-described disadvantages of the conventional file folders.

SUMMARY OF THE INVENTION

The primary objective of the present invention is to provide a file folder which includes a compartment formed therein and which includes a room that may be opened.

In accordance with one aspect of the invention, there is provided a file folder comprising a plate including a front panel having two side portions, two side panels folded from the side portions of the front panels and arranged in perpendicular to the front panel, a bottom panel folded from the front panel and perpendicular to the front panel, a rear panel folded from the bottom panel and arranged in parallel to the front panel, a top panel folded from the rear panel and arranged in parallel to the bottom panel, a cover folded from the top panel for engaging with the front panel, a board including two side portions having two strips folded therefrom and arranged in perpendicular thereto for securing to the side panels so as to form a chamber between the board and the front panel and so as to form a room between the board and the rear panel, the room including two side portions and including an upper portion, a pair of expandable members provided in the side portions of the room and secured between the board and the rear panel so as to allow the upper portion of the room to be opened, at least one partition disposed in the room and arranged in parallel to the rear panel, the partition including side portions secured to the expandable members so as to separate the room into at least two spaces, and hook and loop means for securing the cover to the front panel so as to enclose the chamber and the room.

The front panel includes an upper portion having a notch formed therein such that the documents may be easily engaged into the chamber and may be easily removed from the chamber.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
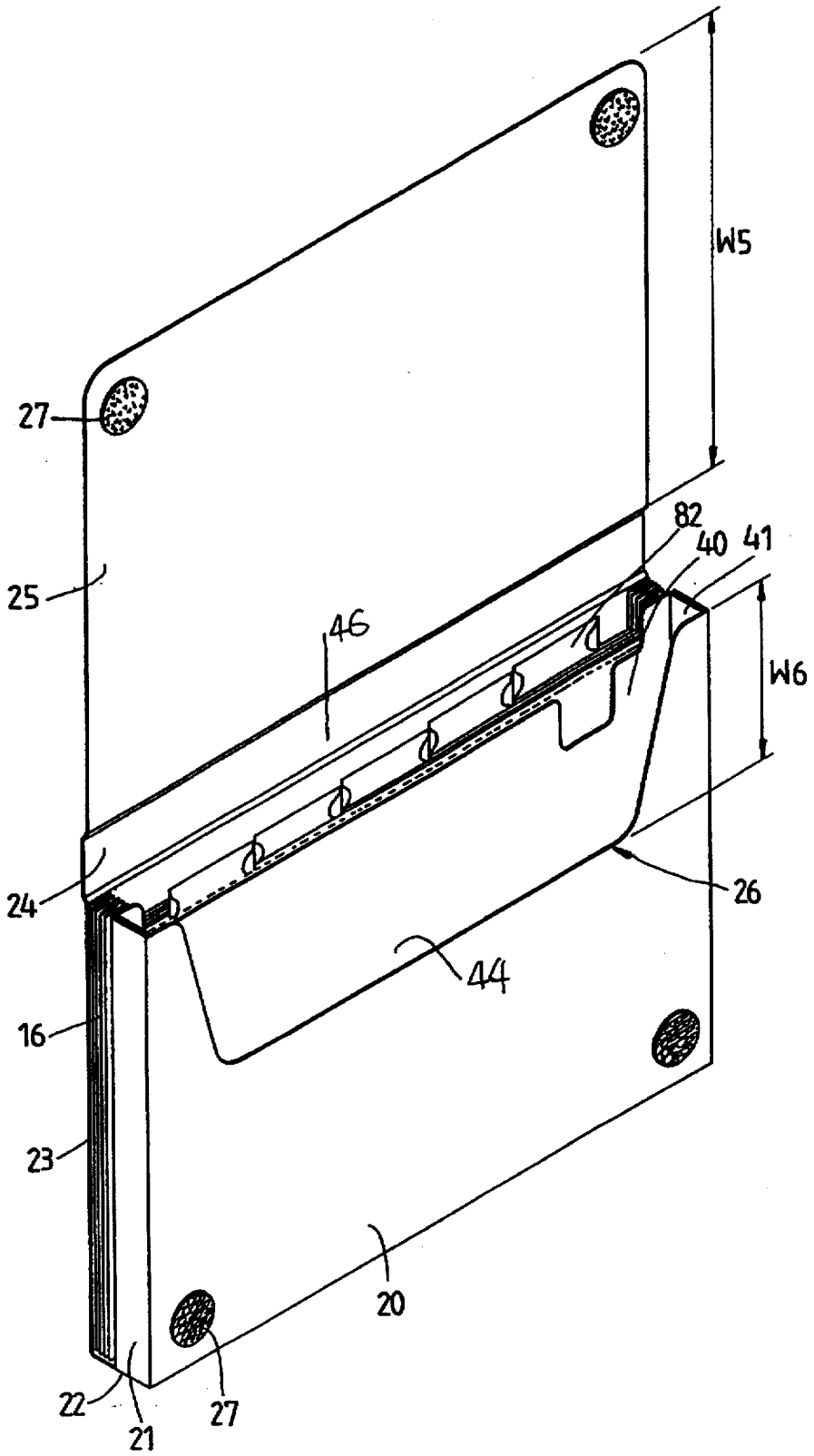
FIG. 1 is a perspective view of a file folder in accordance with the present invention, in which the cover is opened.
Figure 2:
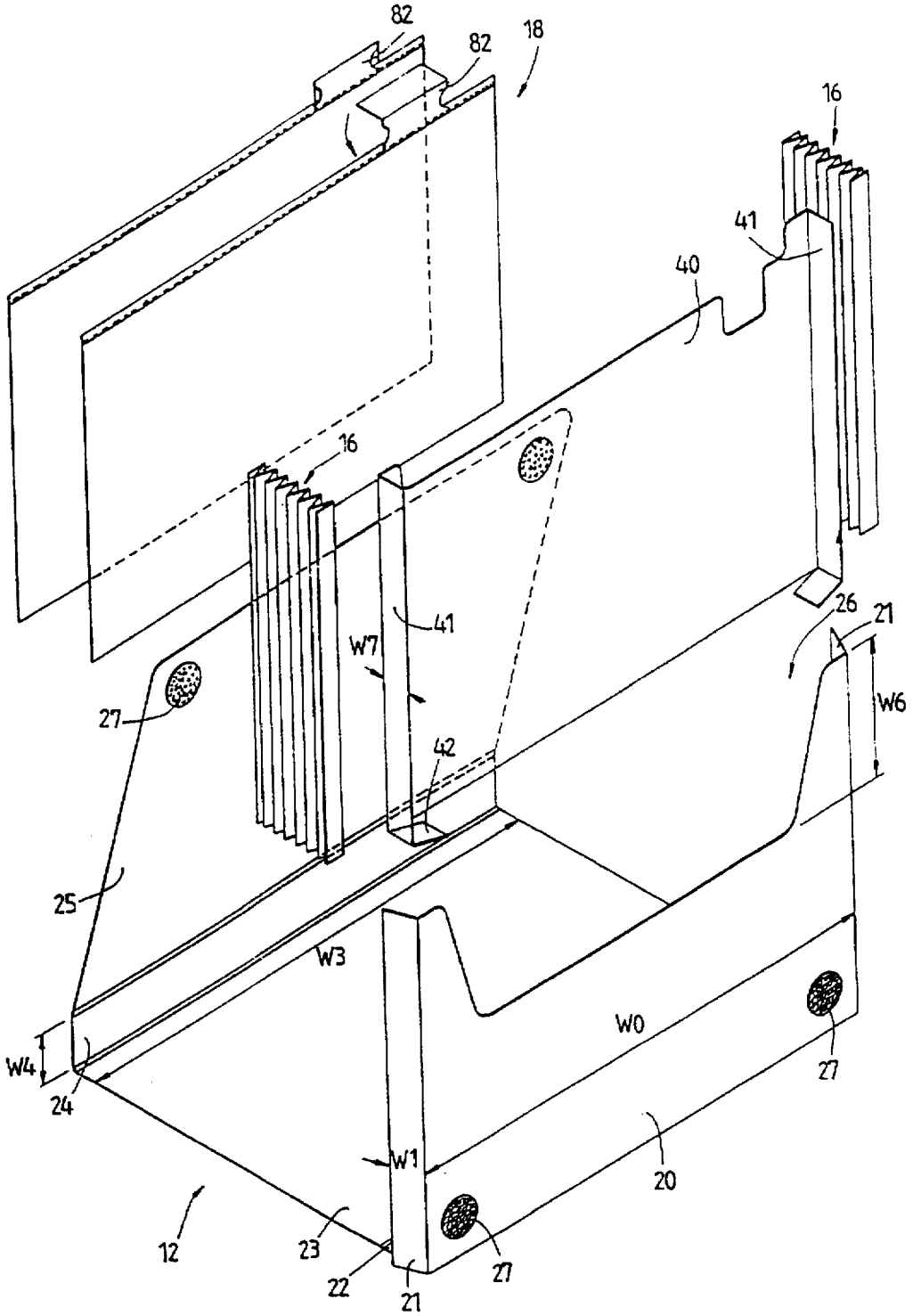
FIG. 2 is an exploded view of the file folder.

Referring to the drawings, a compartmentized file folder in accordance with the present invention comprises a plate 12 including a front panel 20, a pair of side panels 21, a bottom panel 22, a rear panel 23, a top panel 24 and a cover 25 coupled together and foldable one relative to the other. The front panel 20 includes a width of W0 and includes a notch 26 formed in the upper portion and having two hook and loop devices 27 secured to the front portion thereof. The notch 26 includes a depth of W6. The side panels 21 are arranged in perpendicular to the front panel 20. The side panels 21 each includes a width of W1. The bottom panel 22 is foldable relative to the front panel 20 and includes a width of W2. The rear panel 23 is foldable relative to the bottom panel 22 and includes a width W3 as large as that of the front panel 20. The top panel 24 is foldable relative to the rear panel 23 and includes a width W4 identical to that of the bottom panel 22. The cover 25 is foldable relative to the top panel 24 and includes a depth W5 greater than the depth W6 of the notch 26. The cover 25 also includes two hook and loop devices 27 secured thereto for engaging with the hook and loop devices 27 of the front panel 20 such that the cover 25 may be secured to the front panel 20.

A board 40 includes two strips 41 folded therefrom and arranged in perpendicular thereto. The strips 41 each includes a width W7 slightly smaller than the width W1 of the side panels 21 and each includes an ear 42 extended therefrom for engaging with the bottom panel 22 and for securing to the bottom panel 22. The strips 41 are secured to the side panels 21 such that the interior of the file folder is separated into a chamber 44 which is formed between the board 40 and the front panel 20 and a room 46 which is formed between the board 40 and the rear panel 23.

Figure 3:
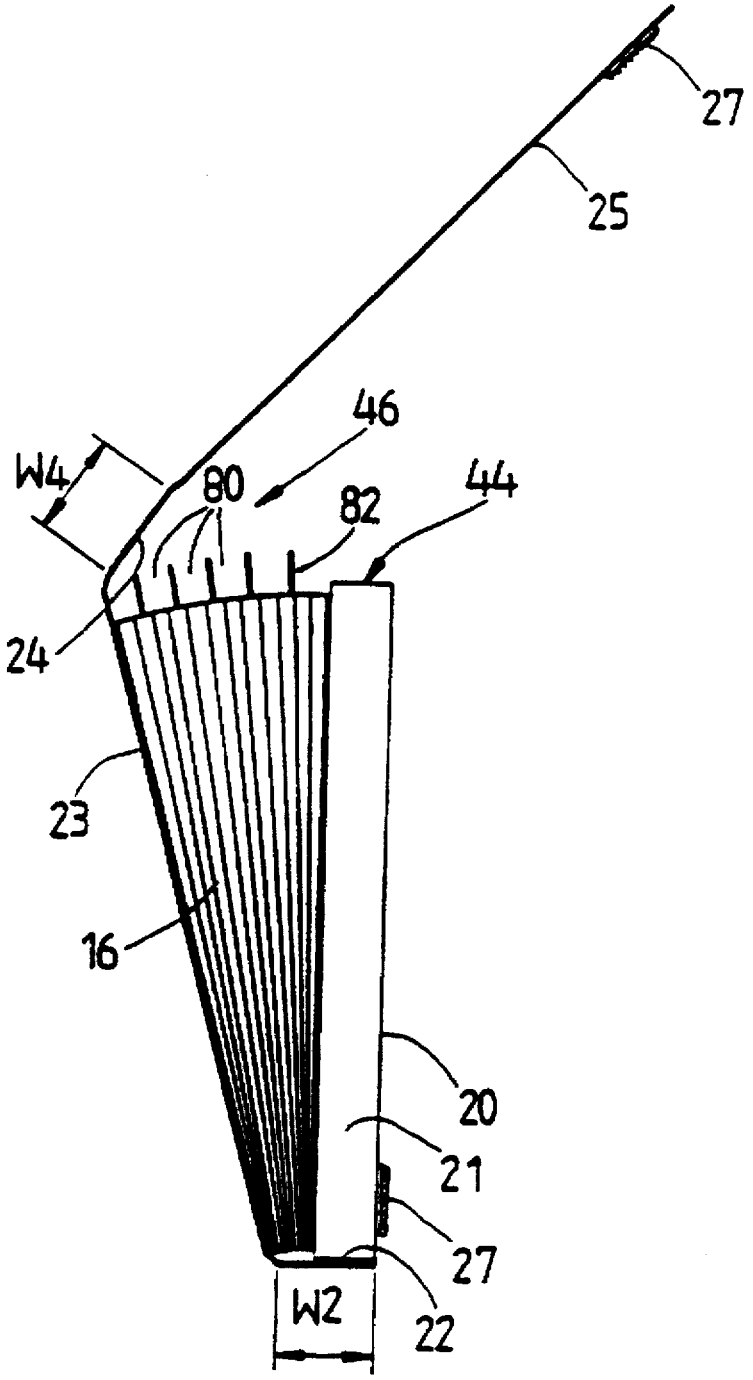
FIG. 3 is a side view illustrating the operation of the file folder.

A pair of expandable members 16 are secured between side portions of the board 40 and the rear panel 12 such that the upper portion of the room 46 may be opened and such that the documents may be easily engaged into the room 46. A number of partitions 18 are disposed in parallel in the room 46 and have side portions secured to the expandable members 16 so as to separate the room 46 into a number of spaces 80 (FIG. 3). The partitions 18 each includes a lug 82 provided thereon for engaging with notes or labels therein.

Accordingly, the file folder in accordance with the present invention includes a board 40 for separating the interior of the file folder into a chamber 44 and a room 46, and includes a number of partitions 18 engaged in the room 46 so as to separate the room 46 into a number of spaces 80, such that the documents may be separately engaged and received in the file folder. In addition, the room 46 may be opened such that the documents may be easily engaged into the spaces 80.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A file folder comprising:

a plate including a front panel which has two side panels folded from two opposite sides of said front panel and arranged in perpendicular to said front panel, a bottom panel folded from said front panel and perpendicular to said front panel, a rear panel folded from said bottom panel and arranged in parallel to said front panel, a top panel folded from said rear panel and arranged in parallel to said bottom panel, a cover folded from said top panel for engaging with said front panel, a board having two strips folded from two opposite sides thereof and said strips being arranged in perpendicular to said board for securing to said side panels so as to form a chamber between said board and said front panel and so as to form a room between said board and said rear panel, a pair of expandable members provided in said room and secured between said board and said rear panel so as to allow an upper portion of said room to be opened, at least one partition disposed in said room and arranged in parallel to said rear panel, said partition including side portions secured to said expandable members so as to separate said room into at least two spaces, and means for securing said cover to said front panel so as to enclose said chamber and said room.

2. A file folder according to claim 1, wherein said front panel includes an upper portion having a notch formed therein.

* * * * *